United States Patent [19]

Nemoto

[11] 3,983,335

[45] Sept. 28, 1976

[54] STYLUS ASSEMBLY AND TRANSDUCER USING SAME

[75] Inventor: Mitsuo Nemoto, Machida, Japan

[73] Assignee: Kabushiki Kaisha Audio-Technica, Machida, Japan

[22] Filed: Oct. 23, 1974

[21] Appl. No.: 517,044

[30] Foreign Application Priority Data

Nov. 27, 1973 Japan ..... 48-133790

[52] U.S. Cl. ..... 179/100.41 K

[51] Int. Cl.[2] ..... H04R 11/12

[58] Field of Search ..... 179/100.41 M, 100.41 K, 179/100.41 Z

[56] References Cited

UNITED STATES PATENTS

| | | | |
|---|---|---|---|
| 3,077,521 | 2/1963 | Ahrens et al. | 179/100.41 K |
| 3,184,555 | 5/1965 | Marshall | 179/100.41 K |
| 3,542,972 | 11/1970 | Braun | 179/100.41 K |
| 3,720,796 | 3/1973 | Honma | 179/100.41 K |
| 3,761,647 | 9/1973 | Nemoto et al. | 179/100.41 K |
| 3,763,335 | 10/1973 | Morita | 179/100.41 M |

FOREIGN PATENTS OR APPLICATIONS

| | | | |
|---|---|---|---|
| 23,881 | 10/1968 | Japan | 179/100.41 K |

OTHER PUBLICATIONS

Moving-Magnetic Stereo by H. Horowitz, Audio, May 1959 pp. 19–21, 46–47.

*Primary Examiner*—Raymond F. Cardillo, Jr.

[57] ABSTRACT

A stylus assembly for an electromechanical vibration transducer comprises a single magnet armature lying in a first imaginary vertical plane which passes through the fulcrum of a cantilever arm and is perpendicular to a second imaginary vertical plane in which the axis of the arm lies, the armature further lying in a first imaginary horizontal plane which is parallel to a second imaginary horizontal plane in which lies a line joining the fulcrum and the center of a stylus tip, the lines joining each end of the armature and fulcrum coinciding with the axes of modulation of a sound groove. An electromechanical vibration transducer incorporating such a stylus assembly comprises pairs of pole pieces each pair defining a gap, each end of the armature being disposed within the gap formed between the respective pair of pole pieces each pair of pole pieces is associated with a magnetic core about which a coil is wound.

6 Claims, 5 Drawing Figures

STYLUS ASSEMBLY AND TRANSDUCER USING SAME

The invention relates to a transducer for simultaneously reproducing a multi-channel signal from a pair of modulated walls of a single groove record disk and more particularly to a transducer having a single armature having opposite ends adapted to vibrate in accordance with the amplitude velocity associated with said modulated walls.

It is known that the vibrational system for a pickup has a resonance point near the upper limit of its reproduction range where its frequency response and mechanical impedance peak. This results in the disadvantage that the stylus may hop during high frequency signal reproduction or a reproducible range of high frequencies may be suppressed. Several techniques have been proposed for suppressing such a resonant peak, e.g. see U.S. Pat. No. 3,077,522 issued to Lee Gunter, Jr. et al. on Feb. 12, 1963. This patent generally discloses a stylus assembly which is readily replaceable when the stylus tip is worn out. Specifically, a single magnet armature in the form of a tube or column is attached to a rear portion of a cantilever arm along its length, and is supported within an axial bore in a tubular bearing made of an elastic material and mounted in a sleeve.

One of the techniques for suppressing a resonant peak in the conventional pickups is to increase the damping resistance of the elastic material which supports the armature. However, it has been found that this results in an increased mechanical impedance in the mid-range frequencies. An alternative technique, used in substantially all presently available pickups involves reducing the equivalent mass of the vibrational system, i.e. the armature, cantilever arm and stylus tip. However, this results in a reduced sensitivity, possible cross modulation distortion in the high frequency range, and susceptibility to damage on account of its reduced structural rigidity. It is therefore apparent that simply selecting a different constructing material modifying the design of the pickup will not completely eliminate the noted resonant peak in the conventional pickup.

Therefore, it is a general object of the invention to provide a transducer of a novel construction which is capable of eliminating the above described disadvantages of a conventional pickups.

It is a specific object of the invention to provide a transducer having a dual resonance vibrational system which differs from conventional pickups in that it is capable of suppressing the mechanical impedance in the high frequency range without increasing the mechanical impedance in the mid-range frequencies.

It is another object of the invention to provide a transducer having a single armature of reduced equivalent mass and which flattens the high range frequency response and broadens the reproducible range.

It is a further object of the invention to provide a stylus assembly for a transducer which is simple in construction, easy to manufacture and which can readily be properly oriented upon replacement when the stylus tip is worn out.

In accordance with the invention, there is provided a transducer including a cantilever arm which carries a stylus tip at its forward end and to the rear end of which is secured a carrier of a material having reduced rigidity compared to that of the cantilever arm, with a single armature being positioned on the carrier. The armature has opposite ends, each of which is subjected to vibrational movement about the other end which acts as a fulcrum, in accordance with the amplitude velocity of each associated modulated wall. As a result of mounting the armature on the cantilever arm through the interposition of the carrier of a reduced rigidity, rather than directly on the arm, the equivalent mass of the dual resonance vibrational system is determined by relatively rigid carrier between the stylus tip and the single armature in contradistinction to the arrangement of U.S. Pat. No. 3,077,522 where the armature is supported within an axial bore in a tubular bearing made of elastic material, where moreover the armature extends along the length of the cantilever arm. A transducer having such a dual resonance vibrational system is not difficult to manufacture, improves the frequency response in the high frequency range and is effective to reduce its mechanical impedance, because the resonance frequency of the carrier can be designed to be in a fairly high range.

In the transducer according to the invention, the cantilever arm is supported by a wire extending rearwardly from the rear end thereof, which wire is damped by a body of elastic material which substantially surrounds it. For details of such support for the vibrational system, reference is made to U.S. Pat. No. 3,720,796 issued to K. Honma on Mar. 13, 1973 and U.S. Pat. No. 3,761,647 issued to M. Nemoto et al. on Sept. 25, 1973. From the foregoing it will be seen that the present invention is directed to a stylus assembly utilizing a single armature which is positioned on the carrier so that each end moves about the other end acting as the fulcrum therefor, the interaction of the carrier between the cantilever arm and the stylus and is furthermore directed to the transducer incorporating such stylus assembly.

The above and other objects, features and advantages of the invention will become apparent from the following detailed description of an embodiment thereof with reference to the drawings, in which.

Figure 1:
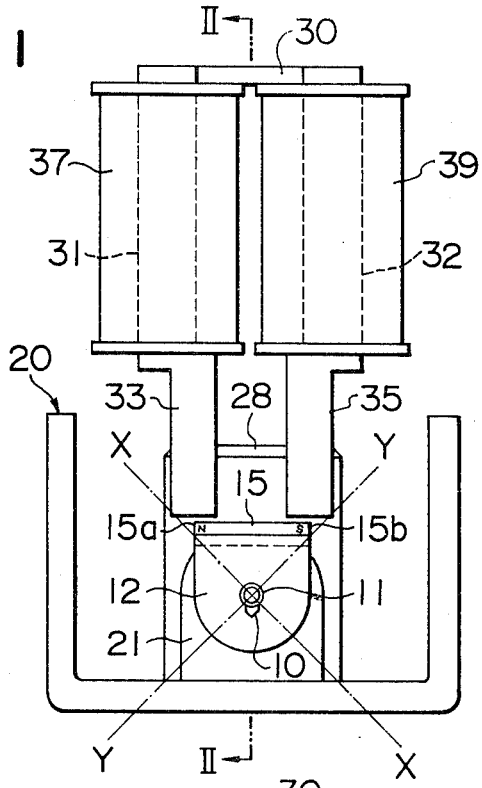
FIG. 1 is a front elevation of the transducer according to the invention.
Figure 2:
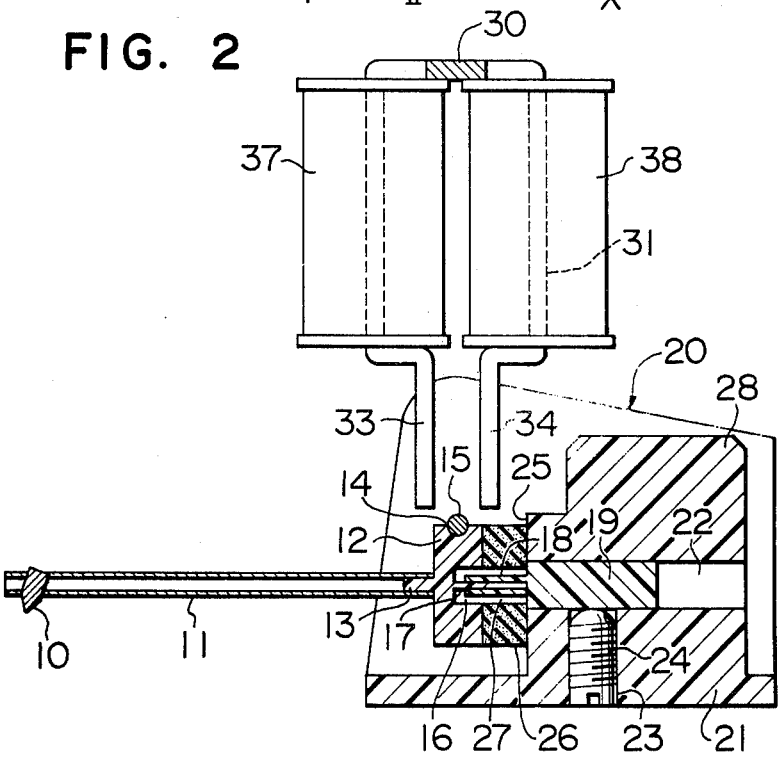
FIG. 2 is a view taken along the line 2—2 shown in FIG. 1.

Referring to the drawings, a stylus tip 10 is carried at one end of a cantilever arm 11, the other end of which is provided with a carrier 12. The carrier 12 is moulded, for example, from synthetic resin such as nylon 66, and thus is of a material which is less rigid than cantilever arm 11 which is generally formed as a tubular body of beryllium, titanium alloy or aluminium. It should be understood that the carrier 12 may be formed of any other non-magnetic material which is less rigid than the material of which the cantilever arm 11 is made. In order to attach the carrier 12 to the rear end of a cantilever arm 11, a projection 13 may be integrally formed on the carrier 12 so as to extend forwardly therefrom for telescopically receiving the end of the tubular cantilever arm 11. However, other means may be used to secure the carrier 12 to the cantilever arm 11. For example, the rear end of the cantilever arm 11 may be received in in a recess formed in the carrier 12. In the example shown, the carrier 12 is of generally rectangle shape and having a semecircular lower portion, and carries a hollow or solid cylindrical armature 15 in a groove 14 formed in the top surface thereof as shown in FIGS. 1 and 2, As will be further described later, the armature 15 is located at a predetermined position on the carrier 12 so that the vibration of the stylus tip 10 may be imparted thereto in an accurate manner. In order to permit the arm 11 as well as the carrier 12 to act as a cantilever, the carrier 12 is formed with a bore 16 which extends from the rear end face thereof along the axis of the cantilever arm 11, with a suspension wire 17 extending rearwardly from the bottom of the bore 16. A mounting rod 19 including a hollow connecting rod 18 is substantially integrally formed with the carrier 12, the rod 18 surrounding the suspension wire 17 except at its base near the bottom of bore 16 as seen in FIG. 2. As a matter of practice, the carrier 12, suspension wire 17, connecting rod 18 and mounting rod 19 may be simultaneously cast from the same material for economical reasons. However, where these members are made separately, it is only necessary that the suspension wire 17 be forced into an axial bore in the connecting rod 18 as shown. The suspension wire 17 may be formed of a metallic wire such as piano wire, and must enable free vibrational motion of the cantilever arm 11. It is preferred that the lengthwise elongation of the wire be minimized. Also it is desirable that the connecting rod 18 be reduced resilience material compated to that of the suspension wire 17.

The stylus assembly shown can be mounted on a mounting member 20 in the same manner as described in the U.S. Pat. Nos. 3,720,796 and 3,761,647 and therefore will not be described in detail. Briefly however, the mounting member 20 includes a base 21 formed with a bore 22, in which the mounting rod 19 is received.

The bore 23 extends in a direction perpendicular to the extent of the bore 22 to intersect therewith, and receives a clamping bolt 24 which can be engaged with the mounting rod 19 to secure it in position. A damper 26 of an elastic material is disposed between the carrier 12 and the forward end face 25 of the mounting member, the damper 26 being formed with an axial bore 27 through which the connecting rod 18 extends. While not apparent from the drawing, the carrier 12 operates to apply a slight degree of axial compression upon the damper 26 against the resilience thereof. To this end, the mounting rod 19 is located at a position within the bore 22 such that the carrier 12 forcibly pulled rearwardly through the suspension wire 17, and the rod 19 is clamped in place by the clamping bolt 24. Stated otherwise the restorative action of the elastic damper 26 acts between the carrier 12 and the base 21 of the mounting member, with the result that motions of the cantilever arm 11, inclusive of the carrier 12, which result from vibration of the stylus tip 10 is not only permitted in any direction about the fulcrum wire 17, which is formed by a point thereon, but also the cantilever arm 11 is free to return to its neutral position. A plug 28 is adapted to be inserted into the body of a cartridge, not shown, for securing the mounting member 20 therein.

Figure 3:
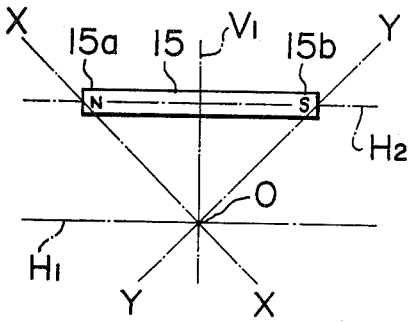
FIGS. 3 and 4 are diagrams for illustrating the positioning of the armature shown in FIG. 1.
Figure 4:
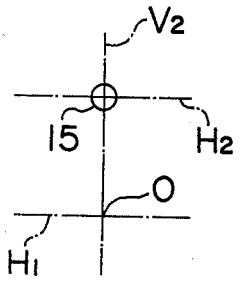

The armature 15 may be secured adhesively within the groove 14 in the carrier 12, or may be embedded within the carrier 12. FIGS. 3 and 4 show how the armature 15 is positioned. In these Figures, numeral 0 represents the fulcrum of wire 17 for vibration of the cantilever arm, V1 a first imaginary vertical plane including the axis of a cantilever arm 11, V2 a second imaginary vertical plane perpendicular to the first vertical plane V1 and including the fulcrum 0, H1 a first imaginary horizontal plane in which lies a line which joins the fulcrum 0 and the center of the stylus tip 10 (or the effective axis of the cantilever arm 11), and H2 a second imaginary horizontal plane parallel to the first imaginary horizontal plane H1, armature 15 lying in the second horizontal plane. The reference characters X—X and Y—Y define the imaginary axes of modulation which represent the projection of the modulated walls of a sound groove. It will be seen, therefore, that the armature 15 lies in the second vertical and horizontal planes V2 and H2, and that the opposite ends 15*a* and 15*b* thereof lie on the respective axes of modulation X—X and Y—Y. With a record disk of 45°—45° system, the axes of mudulation X—X and Y—Y are at an angle of 45° with respect to the first imaginary plane V1, respectively, and form an angle of 90° therebetween, so that the opposite ends 15*a*, 15*b* of the armature 15 and the fulcrum 0 form a isosceles triangle. Assume now that the stylus tip 10 is located within a sound groove and one of the modulated walls moves the stylus tip 10 in the direction of the modulation axis X—X. Then the armature 15 will be pivotally moved about the other modulation axis Y—Y, so that only the end 15*a* of the armature 15 is vibratable about the modulation axis Y—Y. On the other hand, when the stylus tip 10 is moved in the direction of the modulation axis Y—Y by the other modulated wall, only the end 15*b* of the armature 15 will vibrate about the other modulation axis X—X which is at right angles to the modulation axis Y—Y. In practice, however, the stylus tip 10 will be simultaneously be vibrated by both modulated walls when the stylus is tracking a groove in a record disc so that although a complex pattern of vibrations of the respective ends 15*a*, 15*b* of the armature 15 is experienced the motion of these armature ends 15*a*, 15*b* nevertheless accurately correspond to the amplitude velocity of each associated modulated wall. As previously mentioned, the armature 15 must be disposed in the second imaginary vertical plane V2 which passes through the fulcrum 0 in order that the vibrations of the armature 15 correspond to the vibration of the stylus tip 10. It will be appreciated that in accordance with the invention this is achieved by positioning the armature 15 in the vertical plane V1 which substantially passes through the center of the effective free length of the suspension wire 17 since the fulcrum is established on a point thereon.

Figure 5:
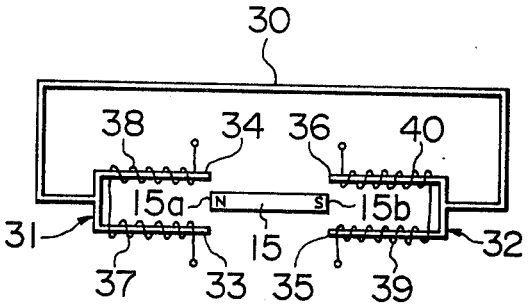
FIG. 5 is a view illustrating the magnetic circuit of the transducer according to the invention.

In FIG. 5, a transducer according to the invention is schematically illustrated and will be seen to comprise a pair of magnetic cores 31, 32 which are coupled by a common yoke 30. The core 31 includes a pair of spaced apart pole pieces 33, 34 while the core 32 similarly includes a pair of pole pieces 35, 36. A pair of series connected coils 37, 38 are wound around the core 31, and similarly a pair of series connected coils 39, 40 are disposed around the core 32. Each pair of pole pieces 33, 34 or 35, 36 defines an independent gap therebetween, and each end 15*a*, 15*b* of the armature 15 is disposed in a gap. In terms of the geometry illustrated in FIGS. 3 and 4, these gaps are located on the opposite sides of the first imaginary vertical plane V1 and lie as does also the armature 15 in the second imaginary vertical plane V2 which as previously described passes through the fulcrum. More specifically, each pair of pole pieses 33, 34 or 35, 36 are disposed to the left and to the right of the armature ends as viewed in FIG. 5. Hence, the end 15*a* of the armature 15 is operatively related to the pair of pole pieces 33, 34, while the other end 15*b* is operatively related to the pair of pole pieces 35, 36. In the illustrated embodiment, the armature 15 comprises a permanent magnet which is magnetized along its axis in such manner that the N- and S-poles are oriented with respect to the gaps defined by the pole pieces 33, 34, and 35, 36, all as shown in FIG. 5.

Accordingly, with the transducer described, when the armature 15 is vibrated such that its one end 15*a* moves about the modulation axis Y—Y, which passes through end 15*b*, a change in the magnetic flux will occur through the core 31 having the pair of pole pieces 33, 34 which resulting in a current flow induced through the coils 37, 38 in a manner well known to those skilled in the art. The armature end 15*a* being thus vibrated about the modulation axis Y—Y induces no motion in the other end 15*b* of the armature so that no current flow is induced in the coild 39, 40 associated with the other end 15*b*. On the other hand, when the other end 15*b* of the armature 15 is vibrated about the modulation axis X—X relative to the adjacent gaps defined by pole pieces 35, 36, current flow will be induced in the coils 39, 40, while no current will be induced through coils 37, 38 because armature end 15a is not vibrated. It will be appreciated that in practice, the magnitude of current induced in the respective pairs of coils corresponds to the degree of vibratory movement of the respective ends 15*a*, 15*b* of the armature 15 relative to their associated gaps.

As described above, in accordance with the invention, the single armature is attached, not directly to the cantilever arm, but to the carrier of a material of reduced rigidity compared to that of the cantilever arm, the stiffness of the carrier serving to suppress peaks in the resonance frequency and mechanical impedance in the high frequency range without increasing the said frequencies in the said range frequencies. Because such suppression is achieved without resort to a damping resistance as presented by an elastic damper, a flat response is attained with a substantially reduced resonance frequency in the high frequency range and without increasing the mechanical impedance in the mid-range frequencies. The use of a single armature enables its equivalent mass to be reduced. Because the armature is mounted at right angles to the cantilever arm, its assembly and alignment is facilitated. The location of the armature within the carrier prevents distortions during sound reproductions which might otherwise occur upon displacement of the armature.

Having described the invention, what is claimed is:

1. A stylus assembly for a stereophonic cartridge comprising an elongate axially extending cantilever arm having a stylus tip at its forward end adapted to track a sound groove having modulated walls, a carrier fixed to said cantilever arm at the rear end thereof, said carrier consisting of a material having a rigidity reduced as compared to that of the centilever arm, a single horizontally disposed armature secured to said carrier at an elevation above the point at which the carrier is fixing to said cantilever arm in an orientation transverse to that of said axially extending cantilever arm, and support means for supporting said cantilever arm, said carrier and armature for vibratory movement and comprising a mounting member fixed in rearwardly spaced relation to said carrier and including a fulcrum wire disposed axially of said cantilever arm and connected between said mounting member and said carrier, said fulcrum wire having a point thereon defining a fulcrum about which said support means is adapted to vibrate, said cantilever arm lying in a first imaginary vertical plane which passes through said armature substantially midway between its opposite ends and said armature lying in a second imaginary vertical plane transverse to the first vertical plane, which second vertical plane passes through said fulcrum, said armature additionally lying in an imaginary horizontal plane which is parallel to the imaginary underlying horizontal plane in which the cantilever arm lies, imaginary lines joining the respective ends of the armature and said fulcrum being projections of said modulated walls of said sound groove which said stylus is adapted to track.

2. A stylus assembly according to claim 1 in which the armature comprises a permanent magnet.

3. A stylus assembly according to claim 1 in which the armature is embedded within the carrier.

4. A stylus assembly according to claim 1 in which the carrier is moulded from synthetic resin.

5. A transducer comprising a pair of magnetic cores having respective pairs of pole pieces, each forming an independent gap between the pole pieces thereof, a common yoke coupling the magnetic cores together, coils disposed on the respective cores, and a stylus assembly including a single horizontally disposed armature having the opposed axial ends thereof operatively related to said gaps, said stylus assembly further including a longitudinally extending cantilever arm carrying a stylus at its forward end adapted to track a sound groove having modulated walls, a carrier member to which the rear end of the cantilever arm is secured and being of a material of reduced rigidity compared to the material of said cantilever arm, said armature being secured to said carrier member at an elevation above that of securement thereto of said cantilever arm in an orientation transverse to the orientation of said cantilever arm, and support means for supporting said cantilever arm, said carrier member and armature secured thereto and for providing vibratory movement about a single fulcrum rearwardly located of the rear end connection of said cantilever arm to said carrier member, said armature lying in a first imaginary vertical plane passing through said fulcrum which first vertical plane is perpendicular to a second imaginary vertical plane in which lies the longitudinally extending cantilever arm, said armature also lying in a first imaginary horizontal plane which is parallel to and above a second imaginary horizontal plane in which lies said fulcrum and the center of the stylus tip, imaginary lines joining the respective ends of the armature and the fulcrum being projections of said modulated walls of said sound groove which said stylus is adapted to track.

6. A transducer according to claim 5 in which the pair of pole pieces are located on the opposite side of the first imaginary vertical plane, each of said independent gaps being defined between the pole pieces of each pair on the respective side of the second imaginary vertical plane.

* * * * *